United States Patent [19]

Cotter et al.

[11] Patent Number: 4,931,202

[45] Date of Patent: Jun. 5, 1990

[54] DETERGENT PELLET COMPOSITION AND PROCESS THEREFOR

[75] Inventors: Terrence Cotter, Southgate; Theodore Anderson, Grosse Ile; Robert Gansser, Riverview, all of Mich.; Lewis R. Kryk, Windsor, Canada; Theodore R. Rieple, Farmington Hills, Mich.

[73] Assignee: Diversey Corporation, Mississauga, Canada

[21] Appl. No.: 215,985

[22] Filed: Jul. 7, 1988

[51] Int. Cl.[5] ..... C11D 7/54

[52] U.S. Cl. ..... 252/99; 252/103; 252/174

[58] Field of Search ..... 252/99, 103, 135, 174

[56] References Cited

U.S. PATENT DOCUMENTS 3,962,106 6/1976 Rubin ..... 252/99

4,422,900 12/1983 Bordelon ..... 159/48.1

*Primary Examiner*—John F. Niebling

*Assistant Examiner*—Isabelle Rodriguez

*Attorney, Agent, or Firm*—Arnold S. Weintraub

[57] ABSTRACT

Highly alkaline detergent compositions are prepared by mixing together, in a mixing device, a melt of alkaline material with a hardness sequestering agent, such as an alkali metal complex phosphate sequestrant. The resulting mixture is, then, pelletized on a chill belt. A source of solid active chlorine pellets is combined with the pelletized mixture. Chlorine degradation is essentially eliminated by combining the alkaline material pellets with the pelletized chlorine source.

10 Claims, 1 Drawing Sheet

DETERGENT PELLET COMPOSITION AND PROCESS THEREFOR

CROSS REFERENCE TO RELATED APPLICATIONS

This application is a continuation-in-part of U.S. Ser. No. 118,959 filed on Nov. 10, 1987, the disclosure of which is hereby incorporated by reference.

BACKGROUND OF THE INVENTION

1. Field of the Invention

This invention relates to detergent pellet compositions. More particularly, the present invention relates to a mixture of detergent pellets of highly alkaline materials and pellets which contain a bleaching agent and methods of manufacture therefor. Representative of the type of the bleaching agent contemplated for use herein is an active chlorine containing compound such as sodium dicloroisocyanurate pellets.

2. Prior Art

The use of highly alkaline detergent compositions containing bleaching agents for warewashing is widely known. There is a wealth of prior art which teaches alkaline powders, flakes, emulsions, liquids and the like.

The art has taught that the incorporation of adjuvants, such as, surfactants, chlorine-sources, chelants, sequestrants and the like is highly desirable in alkaline detergent and especially, in highly alkaline detergents. Furthermore, the art has recognized that the inclusion of complex metal phosphates in highly alkaline detergents is desirable in not only enhancing detergency but, also, because of their sequestering capabilities in hard water environments. However, the art has further recognized the inherent problems of the degradation of active-chlorine sources in highly alkaline environments and has sought suitable solutions therefor.

With respect to the problem of chlorine degradation, the art has not devised an effective method of preventing such degradation, other than the use of plugs of active-chlorine employed within solid, cast detergent bricks, or when mixing chlorine with the alkali material in a molten state, by reducing contact time between the two ingredients.

However, and as noted above, the art still requires means and methods for reducing the amount of chlorine degradation in highly alkaline detergent products. It is to this to which the present invention is directed.

SUMMARY OF THE INVENTION

In accordance with the present invention, a mixture of pellets of highly alkaline detergent compositions and pellets containing a bleaching agent is prepared by:

(a) preparing a first quantity of pellets, containing a highly alkaline material and a sequestering agent; and
(b) preparing a second quantity of chlorine-containing pellets; and
(c) admixing together a measured amount of the first quantity and the second quantity of pellets.

The resulting pellet mixture is a combination of highly alkaline detergent pellets having effective levels of heat-alkaline sensitive material, alkaline material and a highly stable active chlorine source resistant to rapid degradation.

The process by which the pellets which are employed herein are prepared permits easy inclusion of surfactants, thickeners and the like.

For a more complete understanding of the present invention reference is made to the following detailed description and accompanying drawing. In the drawing, like reference characters refer to like parts throughout the views, in which:

DESCRIPTION OF THE PREFERRED EMBODIMENTS

Figure 1:
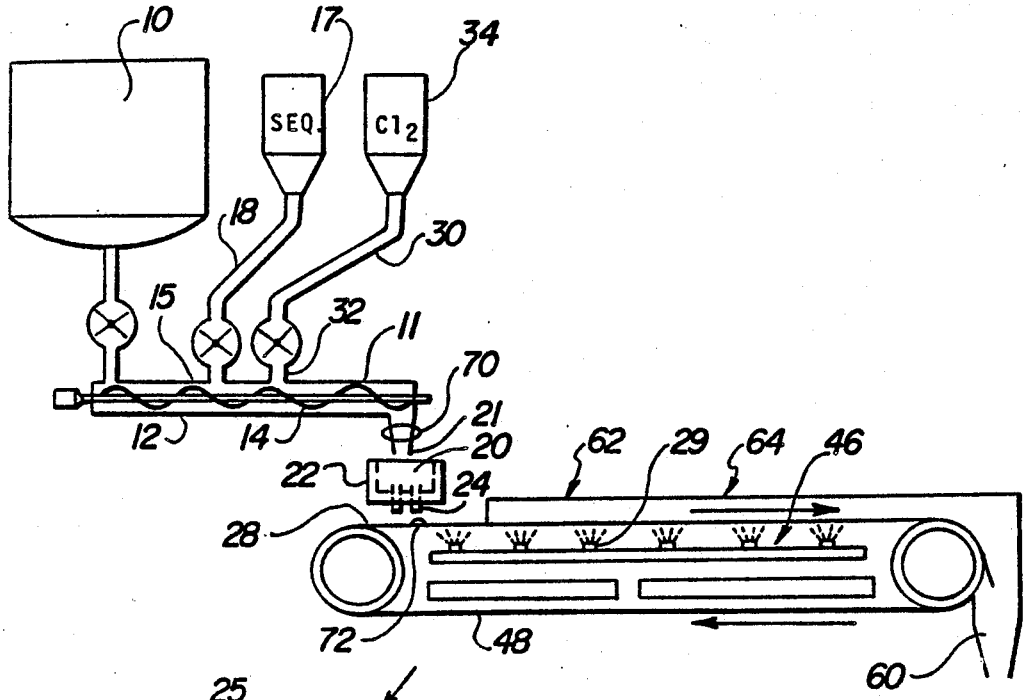
FIG. 1 is a schematic plan of the process employed herein.
Figure 2:
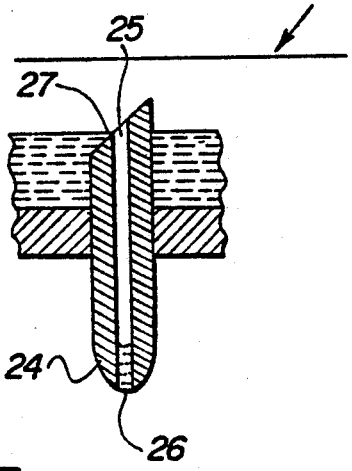
Figure 3:
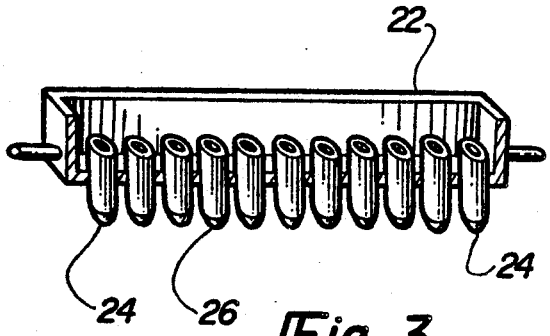
Figure 4:
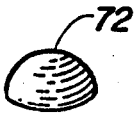

Now, and with reference to the drawing, and in particular FIG. 1, and as disclosed in the above-referred to copending application there is depicted therein a process for preparing a mixture of highly alkaline detergent pellets and chlorine pellets in accordance herewith. The process hereof, generally, comprises:

(a) preparing a first quantity of pellets containing a highly alkaline material and a sequestering agent;
(b) preparing a second quantity of chlorine containing pellets;
(c) admixing together measured amounts of the first quantity and the second quantity;

As disclosed in the copending application, and as shown in FIG. 1 hereof in preparing the highly alkaline pellet the highly alkaline detergent mixture is dispensed from a mixer 22, through a transfer pipe 24 which is connected to a distribution box 26. A chill belt 28 is disposed immediately below the distribution box 26 connected to drop tubes 25. The chill belt 28 receives thereon the liquid drops issuing from the drop tubes of the distribution box. The drops of liquid are solidified and pelletized usually in about 5 to 15 seconds.

The means for combining the alkaline pellets and the chlorine-containing pellets comprises a system of conveyors including the chill belt 28, a first vibrating conveyor 30 and a second vibrating conveyor 32. The first vibrating conveyor 30 runs perpendicular to the chill belt 28 and receives alkali pellets 10 from the chill belt 28 in measured quantities. The second vibrating conveyor 32, runs perpendicular to the first vibrating conveyor 30.

The chill belt 28 is an endless conveyor-type belt having an upper end 27 located below the distribution box and a lower end 29 located a distance from the distribution box 26. The chill belt moves the formed pellets to the first vibrating conveyor 30 located at the lower and of the chill belt 28. The alkali pellets 10 are removed onto a first conveyor belt by means of a doctor blade 40. The highly alkaline pellets are combined with the chlorine-containing pellets 12 on the first vibrating conveyor when the chlorine-containing tablets 12 are transported onto the first vibrating conveor via a second vibrating conveyor 32 running from a chlorine-containing pellet supply hopper 34.

The alkali-pellet chlorine pellet mixture is transported into a finished product collection hopper 36 via the first vibrating conveyor 30.

The contents of the collection hopper 36 are then dispensed into packaging equipment wherefrom they may be dispensed into suitable containers (not shown).

As is known to those skilled in the art to which the present invention pertains, chlorine degradation is prevalent in a highly alkaline detergent environment. When the alkali detergent is combined in its molten state with chlorine, degradation of chlorine is ordinarily, upwards of 50 percent. By practicing the present invention chlorine degradation is reduced to almost zero. Reduction of chlorine degradation is achieved by the omission of contact time between the chlorine source and the molten alkaline mixture. Thus by incorporating active-chlorine pellets with the alkaline pellets mixture there is almost no resulting chlorine loss.

It is to be appreciated that the present invention is applicable to the formation of any type of detergent pellet mixture such as, those useful in laundering, food processing, and the like, but is particularly advantageous to the formation of warewashing detergents.

As noted, the present invention is particularly suited for the manufacture of a mixture of highly caustic alkali metal hydroxide pellets containing a complex phosphate sequestrant, e.g. sodium tripolyphosphate and pellets providing a chlorine source.

Representative of the alkaline materials useful in the present invention include hydratable metal hydroxides, such as sodium hydroxide and potassium hydroxide; hydratable silicates, such as sodium metasilicate and mixtures thereof.

As noted, because of the use of an intermediate feed and short contact times in the molten alkaline material, heat-alkaline sensitive material degradation is substantially reduced. Thus, the present invention is particularly advantageous for use with highly alkaline materials in admixture with sequestrants which ordinarily revert in a highly alkaline, elevated temperature environment. Thus, the process of the present invention is particularly advantageous with sequestrants which revert in highly alkaline environments, such as, complex phosphate sequestrants, including sodium tripolyphosphate, sodium hexametaphosphate, and the like, as well as mixtures thereof. Phosphates, contemplated for use herein, are of the formula $M(PO_3M)_nOM$ or the corresponding cyclic compounds:

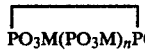

$$PO_3M(PO_3M)_nPO_3M,$$

wherein M is an alkali metal and n is a number ranging from 1 to about 60, typically less than 10 for cyclic phosphates, typical examples of such phosphates being alkaline condensed phosphates (i.e. polyphosphates) such as sodium or potassium pyrophosphate, sodium or potassium tripolyphosphate, sodium or potassium hexametaphosphate, etc.; carbonates such as sodium or potassium carbonate; borates, such as sodium borate; etc.

It should be noted that organic sequestrants such as citric acid, the alkali metal salts of nitrilotriacetic acid (NTA), EDTA, gluconates, polyelectrolytes, and the like can be used herein.

Typical chlorine sources, which may be utilized in the chlorine pellet formulation include but are not limited to conventional hypochlorites, chlorinated isocyanurates, chlorinated trisodium phosphate and sodium chlorite, and the like, as well as mixtures thereof.

The preferred chlorine source is a sodium dicloroisocyanurate pellet mixture. The pellets are a commercially available mixture comprising ACL 56 (dihydrate) and ACL 60 (anhydrous) material available from Monsanto Chemical. Pellet mixtures of ACL 56 and ACL 60 may be utilized in weight ratios from between 20:80 to 80:20 and are stable to at least 120° F. The preferred mixture of ACL 56 (dihydrate) and ACL 60 pellets is a 50:50 weight ratio. The dichlorisocyanurate pellet may also contain boric acid, present in quantities between 1 percent and 10 percent by weight as a tablet processing aid.

In the practice of the present invention, other types of pellets, such as hydrated or anhydrous highly alkaline material pellets, surfactant pellets and the like can be introduced onto the chill belt 28 or into the hopper 60 along with the alkaline-complex phosphate pellets, wherefrom they are deposited into a suitable container (not shown). Thus, it is possible to formulate a pellet detergent mixture such as:

(a) a first quantity of pellets containing caustic and a hardness sequestering agent; and (b) a second quantity of tablets of active chlorine.

Ordinarily, such a mixture will, principally, comprise from about 50 percent to 99.9 percent, by weight of the first quantity of pellets, from about 0.1 percent to about 50 percent by weight of the second quantity of pellets.

In principle, it is to be appreciated that there has been described herein a process for manufacturing highly alkaline detergent materials which reduces the problem of chlorine degradation normally encountered therewith by eliminating contact between the molten alkaline material and the chlorine.

Having, thus, described the invention, what is claimed is:

1. A process for manufacturing a highly alkaline detergent pellet and chlorine pellet mixture, comprising:

(a) preparing a first quantity of pellets containing a caustic and a hardness sequestering agent by:

(i) heating a concentrated aqueious alkaline material selected from the group consisting of alkali metal hydroxides, and mixtures thereof to an elevated temperature;

(ii) admixing a sequestrant with the alkali metal hydroxide to form a detergent mixture;

(iii) dispensing the concentrated aqueous alkaline material into a feed tube;

(iv) dropping droplets of the mixture from feed tube box onto a chill belt to form solid pellets thereof, consisting essentially of alkaline material and sequestrant;

(b) measuring a second quantity of pre-prepared chlorine pellets;

(c) admixing together a measured amount of the first quantity and the second quantity of pellets.

2. The process of claim 1 wherein the second quantity of chlorine pellets contains a chlorine source selected from the group comprising: sodium chlorite, sodium dichloroisocyanurate, and chlorinated trisodium phosphate.

3. The process of claim 1 wherein the chlorine source comprises sodium dichloroisocyanurate pellets.

4. The process of claim 3 wherein the chlorine source is a mixture of sodium dichloroisocyanurate pellets.

5. The process of claim 4 wherein the mixture comprises dihydrate dichloroisocynurate pellets and anhydrous dichloroisocyanurate pellets present in a respective weight ratio of between about 20:80 to about 80:20.

6. The process of claim 4 wherein the ratio of the mixture of the dihydrate of dichloroisocyanurate pellets to the anhydrous dichloroisocyanurate pellets is present in a 50:50 weight ratio.

7. A highly alkaline detergent composition, comprising:

(a) a first quantity of alkaline pellets, each pellet of the first quantity comprising from about 30 to about 80 percent, by weight, of an alkaline material selected from the group consisting of: alkali metal hydroxides and mixtures thereof, and from about 5 to about 50 percent, by weight, of a sequestrant, based on the total weight of the pellet; and (b) a second quantity of pellets, the second pellets being pellets of an active chlorine source.

8. The detergent composition of claim 7 wherein (a) the first quantity of alkaline pellets is present in an amount ranging from about 50 percent, by weight, to about 99.9 percent, by weight, based on the total weight of pellets;

(b) the second quantity of chlorine pellets is present in an amount ranging from about 0.1 percent, by weight, to about 50 percent, by weight, based on the total weight of pellets.

9. The process of claim 1 wherein the sequestrant comprises an alkali metal phosphate.

10. The detergent composition of claim 7, wherein the sequestrant comprises an alkali metal phosphate.

* * * * *